US010344541B2

(12) United States Patent
Delgado

(10) Patent No.: US 10,344,541 B2
(45) Date of Patent: Jul. 9, 2019

(54) DOWNHOLE TOOL CONNECTION ASSEMBLY AND METHOD

(71) Applicant: SCHLUMBERGER TECHNOLOGY CORPORATION, Sugar Land, TX (US)

(72) Inventor: Miguel Marcel Jose Delgado, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 113 days.

(21) Appl. No.: 14/873,262

(22) Filed: Oct. 2, 2015

(65) Prior Publication Data

US 2016/0102505 A1 Apr. 14, 2016

Related U.S. Application Data

(60) Provisional application No. 62/061,647, filed on Oct. 8, 2014.

(51) Int. Cl.

| | |
|---|---|
| ***E21B 17/10*** | (2006.01) |
| ***E21B 7/08*** | (2006.01) |
| ***E21B 4/04*** | (2006.01) |
| ***E21B 4/02*** | (2006.01) |
| ***E21B 17/042*** | (2006.01) |
| ***E21B 19/16*** | (2006.01) |
| ***E21B 17/043*** | (2006.01) |

(52) U.S. Cl.

CPC ..... *E21B 17/042* (2013.01); *E21B 17/043* (2013.01); *E21B 19/16* (2013.01)

(58) Field of Classification Search

None

See application file for complete search history.

(56) References Cited

U.S. PATENT DOCUMENTS

| | | | | |
|---|---|---|---|---|
| 2,296,198 A * | 9/1942 | Boynton | ..... | E21B 17/046 285/111 |
| H001329 H | 7/1994 | Bailey et al. | | |
| 7,188,685 B2 | 3/2007 | Downton et al. | | |

(Continued)

FOREIGN PATENT DOCUMENTS

| | | |
|---|---|---|
| WO | 2011008690 A1 | 1/2011 |
| WO | 2014099902 A1 | 6/2014 |
| WO | 2014108756 A1 | 7/2014 |

OTHER PUBLICATIONS

International Search Report and Written Opinion issued in related International Application No. PCT/US2015/054133 dated Nov. 26, 2015.

*Primary Examiner* — Matthew R Buck
*Assistant Examiner* — Douglas S Wood

(57) ABSTRACT

In accordance to an aspect a connection to attach a first downhole tool to a second downhole tool includes an externally threaded member positioned about the first downhole tool and an internally threaded member disposed with the second downhole tool to threadedly mate with the externally threaded member, wherein threadedly connecting the externally threaded member with the internally threaded member interconnects the first downhole tool and the second downhole tool with a defined tensile force and a compressive force at an interface between a hard shoulder of the first downhole tool and a hard shoulder of the second downhole tool.

20 Claims, 4 Drawing Sheets

(56) References Cited

U.S. PATENT DOCUMENTS

| | | | | |
|---|---|---|---|---|
| 7,390,032 | B2 * | 6/2008 | Hughes | E21B 17/028 285/330 |
| 8,201,645 | B2 * | 6/2012 | Hall | E21B 47/011 175/320 |
| 8,627,901 | B1 * | 1/2014 | Underwood | E21B 7/14 175/107 |
| 8,763,725 | B2 | 7/2014 | Downton | |
| 9,109,417 | B2 * | 8/2015 | Leiper | E21B 37/00 |
| 9,915,387 | B2 * | 3/2018 | Holmen | F16L 25/021 |
| 2008/0303274 | A1 | 12/2008 | Mazzaferro et al. | |
| 2015/0322730 | A1 * | 11/2015 | Gallagher | E21B 17/01 166/367 |

* cited by examiner

DOWNHOLE TOOL CONNECTION ASSEMBLY AND METHOD

CROSS-REFERENCE TO RELATED APPLICATIONS

This application claims priority to U.S. Provisional Application No. 62/061,647 filed on Oct. 8, 2014, the entire contents of which is hereby incorporated by reference herein.

BACKGROUND

This section provides background information to facilitate a better understanding of the various aspects of the disclosure. It should be understood that the statements in this section of this document are to be read in this light, and not as admissions of prior art.

Sections or subsections of downhole tools, for example drilling and measurement tools, are often interconnected by bolts. For example, interconnection of a power generation section, electronics, modulator devices, and actuators. The bolts ensure a high tension force between the sections for example 40 kN.

Bolted connections can be troublesome, in particular in the small section of drilling and measurement tools. These connections are similar to a flange configuration as the center portion of the tool is utilized for the electrical and hydraulic connections. The bolts are located at the periphery of the tubular tool. The bolts have to be protected from the fluid flow with fin shaped sections that can be expensive to machine and generally require welding. The bolts have to be extremely robust and are often constructed of non-standard exotic alloys such as MP35N.

SUMMARY

In accordance to an embodiment a downhole tool connection assembly includes an externally threaded member positioned about a first downhole tool an internally threaded member disposed with a second downhole tool to threadedly mate with the externally threaded member, one of the threaded members rotatably disposed about the downhole tool, and a stop located on one of the first downhole tool and the second downhole tool to act on one of the internally threaded member and the externally threaded member when threadedly connected, whereby the threaded connection interconnects the first downhole tool and the second downhole tool with a defined tensile force and a compressive force at an interface between a first hard shoulder of the first downhole tool and a second hard shoulder of the second downhole tool. The tool connection assembly may be utilized to connect tool members including for example internal electrical and or hydraulic connections.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
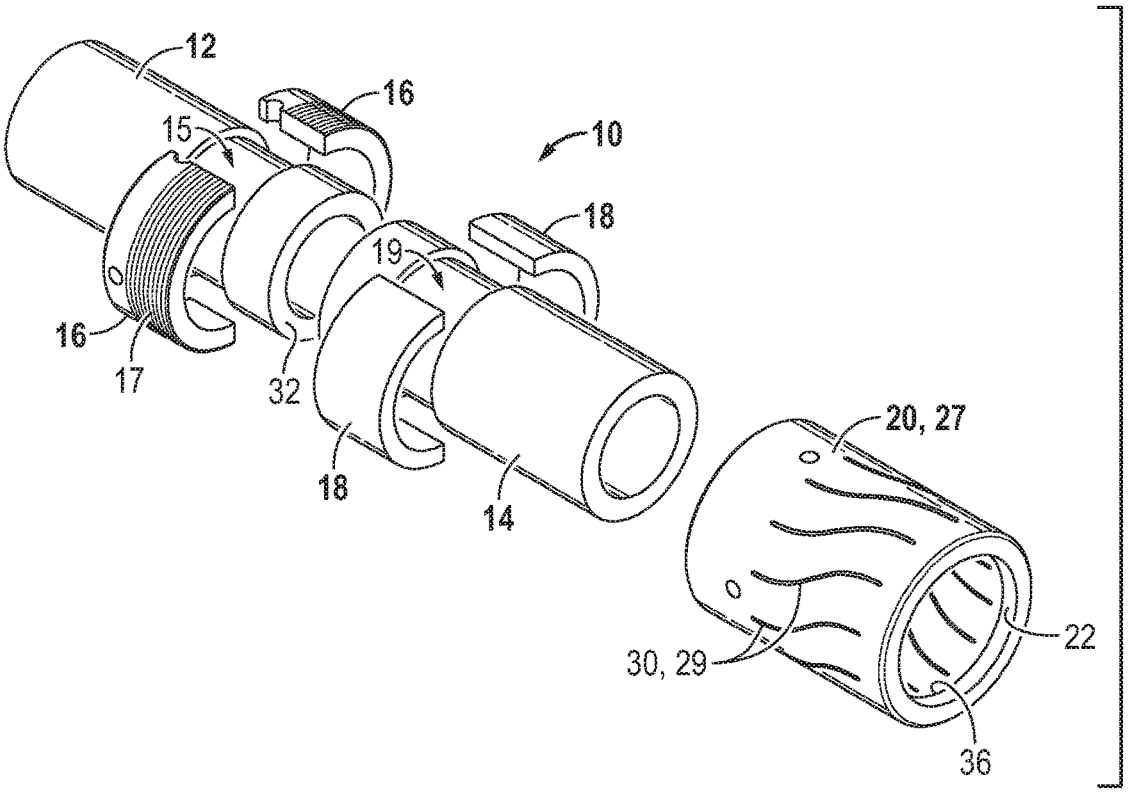
FIG. 1 is a schematic view of a downhole tool connection assembly according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element may be utilized to more clearly describe some elements. Commonly, these terms relate to a reference point such as the surface from which drilling operations are initiated.

Devices, systems and methods are disclosed for providing an elastic deformation connection between a first downhole tool and a second downhole tool. The elastic deformation connection may provide a defined tensile force. In accordance to an aspect a connection to attach a first downhole tool to a second downhole tool includes an externally threaded member positioned about the first downhole tool and an internally threaded member disposed with the second downhole tool to threadedly mate with the externally threaded member, wherein threadedly connecting the externally threaded member with the internally threaded member interconnects the first downhole tool and the second downhole tool with a defined tensile force and a compressive force at an interface between a hard shoulder of the first downhole tool and a hard shoulder of the second downhole tool.

In accordance to one or more aspects of the disclosure, a connection assembly 10 includes an axially elastic deformable member, also referred to as an elastic deformable sleeve ("EDS"). The EDS can be utilized to interconnected two tubular sections 12, 14 or joints or two sections or subsections for example of a downhole tool housing or body with a defined tension. The defined tension is set by the configuration of the EDS, for example a tensioning element (e.g., weakness lines, spring, etc.) and/or by total axial deformation allowed. The defined tension can be adjusted for specific connection assemblies for example by changing the length and shape of weakness lines or the axial deformation allowed or standardized to a nominal tension force across different tools.

Figure 7:
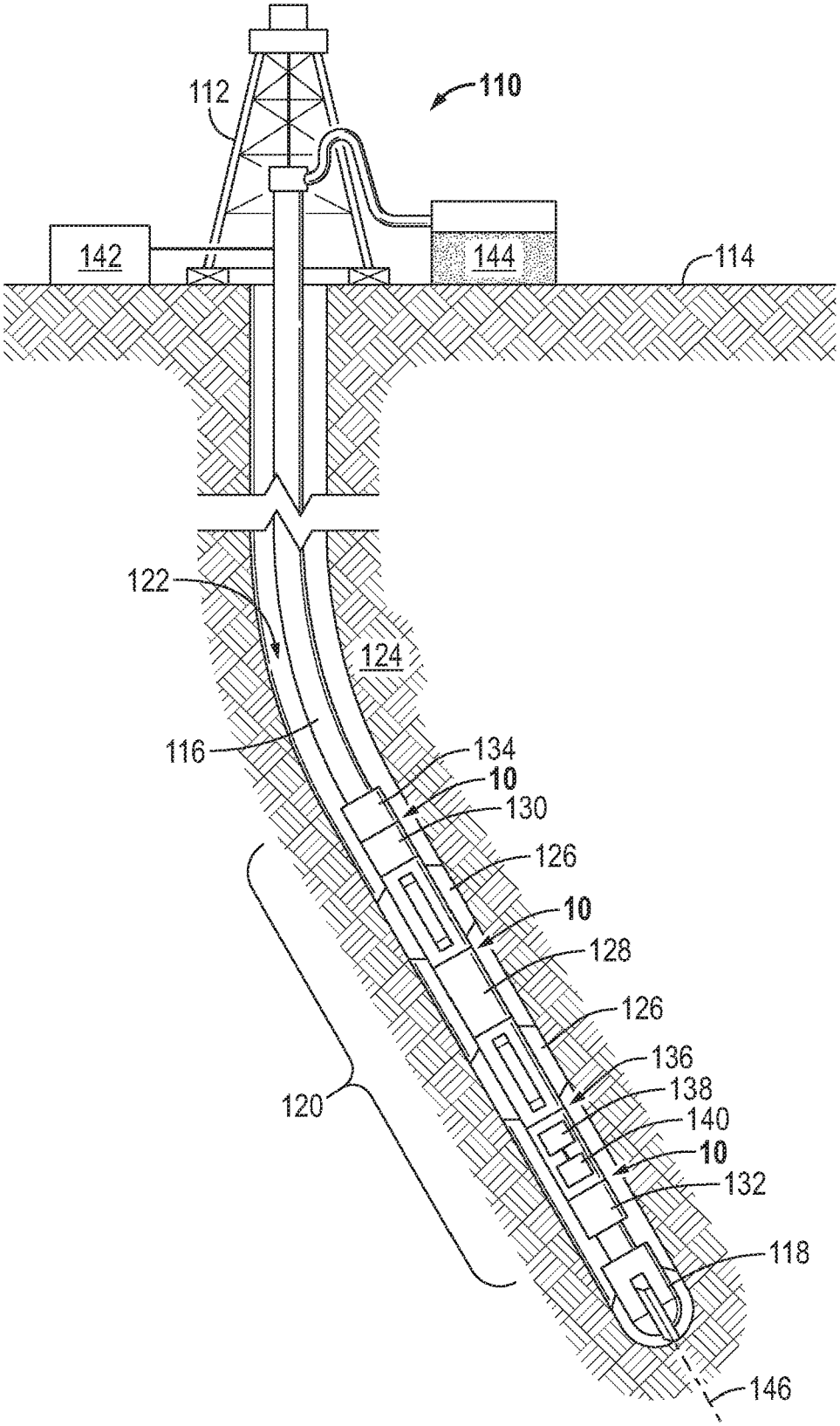
FIG. 7 illustrates a drilling system incorporating a downhole tool connection assembly in accordance to one or more aspects for drilling a wellbore.

Referring first to FIG. 7, an embodiment of a drilling system, generally denoted by the numeral 100, incorporating a downhole tool connection assembly 10 is illustrated. Directional drilling system 100 includes a rig 112 located at surface 114 and a drill string 116 suspended from rig 112. A drill bit 118 is disposed with a bottom hole assembly ("BHA") 120 and deployed on drill string 116 to drill (i.e., propagate) borehole 122 into formation 124.

The depicted BHA 120 includes one or more stabilizers 126, a measurement-while-drilling ("MWD") module or sub 128, a logging-while-drilling ("LWD") module or sub 130, and a steering device 132 (e.g., bias unit, RSS device, steering actuator, pistons, pads), and a power generation module or sub 134. The illustrated directional drilling system 100 includes a downhole steering control system 136, e.g. control unit or attitude hold controller, disposed with BHA 120 and operationally connected with steering device 132 to maintain drill bit 118 and BHA 120 on a desired drill attitude to propagate borehole 122 along the desired path (i.e., target attitude). Depicted downhole steering control system 136 includes a downhole processor 138 and direction and inclination ("D & I") sensors 140, for example, accelerometers and magnetometers. Downhole steering control system 136 may be a closed-loop system that interfaces directly with BHA 120 sensors, i.e., D & I sensors 140, MWD sub 128 sensors, and steering device 132 to control the drill attitude. Downhole steering control system 136 may be, for example, a unit configured as a roll stabilized or a strap down control unit. Although embodiments are described primarily with reference to rotary steerable systems, it is recognized that embodiments may be utilized with non-RSS directional drilling tools. Directional drilling system 100 includes drilling fluid or mud 144 that can be circulated from surface 114 through the axial bore of drill string 116 and returned to surface 114 through the annulus between drill string 116 and formation 124.

The tool's attitude (e.g., drill attitude) is generally identified as the axis 146 of BHA 120. Attitude commands may be inputted (i.e., transmitted) from a directional driller or trajectory controller generally identified as the surface controller 142 (e.g., processor) in the illustrated embodiment. Signals, such as the demand attitude commands, may be transmitted for example via mud pulse telemetry (e.g., modulators), wired pipe, acoustic telemetry, and wireless transmissions. Accordingly, upon directional inputs from surface controller 142, downhole steering control system 136 controls the propagation of borehole 122 for example by operating steering device 132 to steer the drill bit and to create a deviation, dogleg or curve in the borehole along the desired path. In particular, steering device 132 is actuated to drive the drill bit to a set point. The steering device or bias unit may be referred to as the main actuation portion of the directional drilling tool and may be categorized as a push-the-bit, point-the-bit, or hybrid device.

In point-the-bit devices, the axis of rotation of the drill bit 118 is deviated from the local axis of bottom hole assembly 120 in the general direction of the desired path (target attitude). The borehole is propagated in accordance with the customary three-point geometry defined by upper and lower stabilizer touch points and the drill bit 118 touch point. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer.

In the push-the-bit rotary steerable system there is usually no specially identified mechanism to deviate the drill bit axis from the local bottom hole assembly axis; instead, the requisite non-collinear condition is achieved by causing either or both of the upper or lower stabilizers to apply an eccentric force or displacement in a direction that is preferentially orientated with respect to the direction of the borehole propagation. Again, there are many ways in which this may be achieved, including non-rotating (with respect to the hole) eccentric stabilizers (displacement based approaches) and eccentric actuators that apply force to the drill bit in the desired steering direction, e.g. by extending steering actuators into contact with the surface of the borehole. Again, steering is achieved by creating non co-linearity between the drill bit and at least two other touch points.

The drilling system may be of a hybrid type, for example having a rotatable collar, a sleeve mounted on the collar so as to rotate with the collar, and a universal joint permitting angular movement of the sleeve relative to the collar to allow tilting of the axis of the sleeve relative to that of the collar. Actuators control the relative angles of the axes of the sleeve and the collar. By appropriate control of the actuators, the sleeve can be held in a substantially desired orientation while the collar rotates. Non-limiting examples of hybrid systems are disclosed for example in U.S. Pat. Nos. 8,763,725 and 7,188,685.

With reference to FIG. 7, downhole tool connection assembly 10 is described in particular with reference to the bottom hole assembly 120, however, connections 10 may be utilized throughout the drill string 116.

Figure 2:
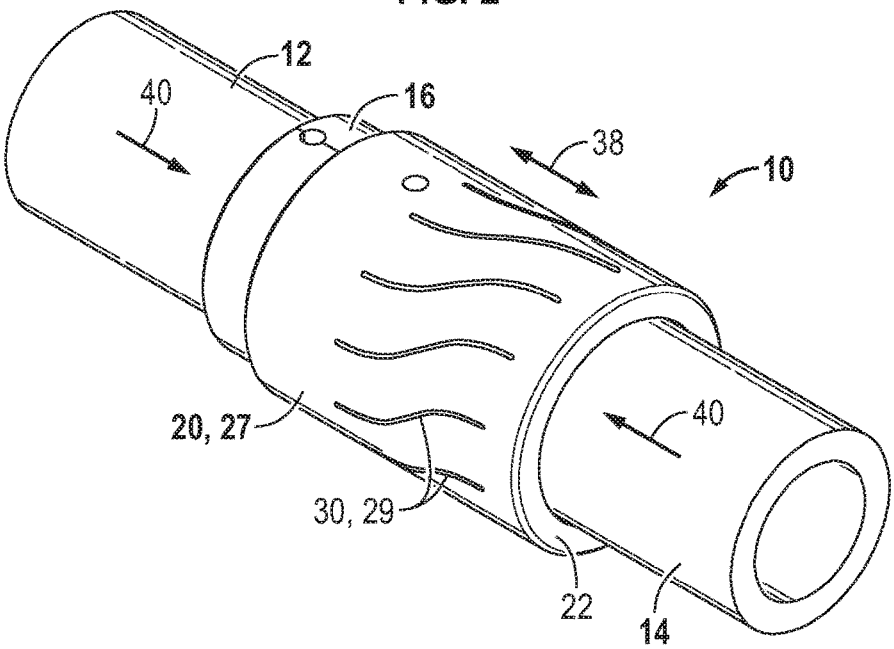
FIG. 2 is a schematic view of two tubular tool sections interconnected by a downhole tool connection assembly according to one or more aspects of the disclosure.

FIGS. 1 and 2 illustrate a connection assembly, generally denoted by the numeral 10, and method in accordance to one or more embodiments. Connection assembly 10 is utilized to interconnect a first tool section 12 and a second tool section 14. An external threaded member 16 is disposed about the first tool section 12 for example in a groove 15 (e.g., recess) such that the first threaded member 16 may rotate relative to first tool section 12. Groove 15 is located proximate to the terminal hard shoulder or face 32 of the first tool section. In FIG. 1 the external threaded member 16 is illustrated as a split nut having external threads 17. The second tool section 14 carries a removable shoulder or stop 18, for example disposed in a recess 19 on the second tool section 14 proximate to the terminal hard shoulder or face 33 of the second tool section. An elastic deformable member 20 includes internal threads 21 (see, e.g. FIG. 3) for connecting with the threads 17 of the external threaded member 16. In FIGS. 1 and 2 the elastic deformable member 20 is depicted as a sleeve identified specifically with the reference number 27.

Figure 3:
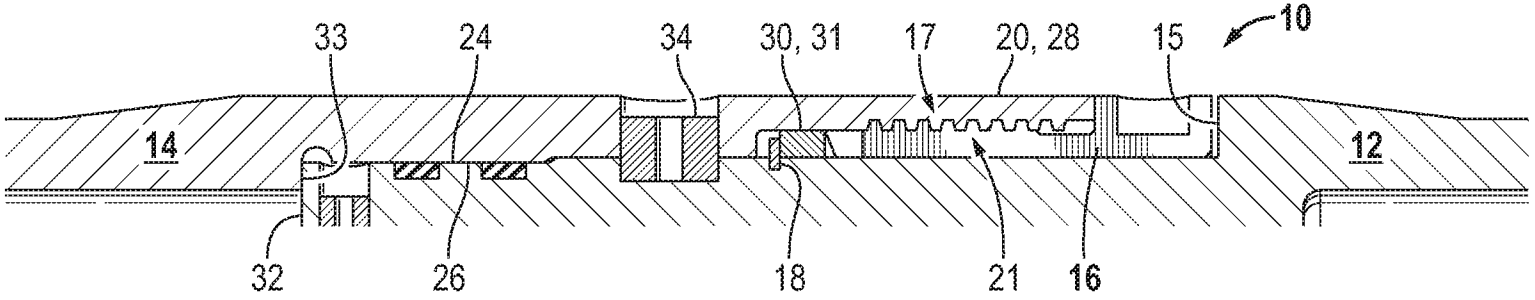
FIGS. 3 and 4 are cut-away views of a downhole tool connection assembly according to one or more aspects of the disclosure.
Figure 4:
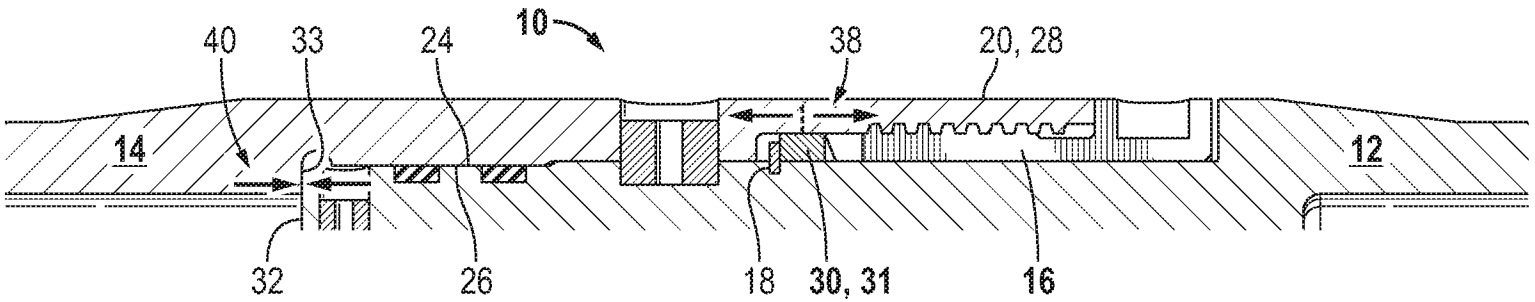
Figure 5:
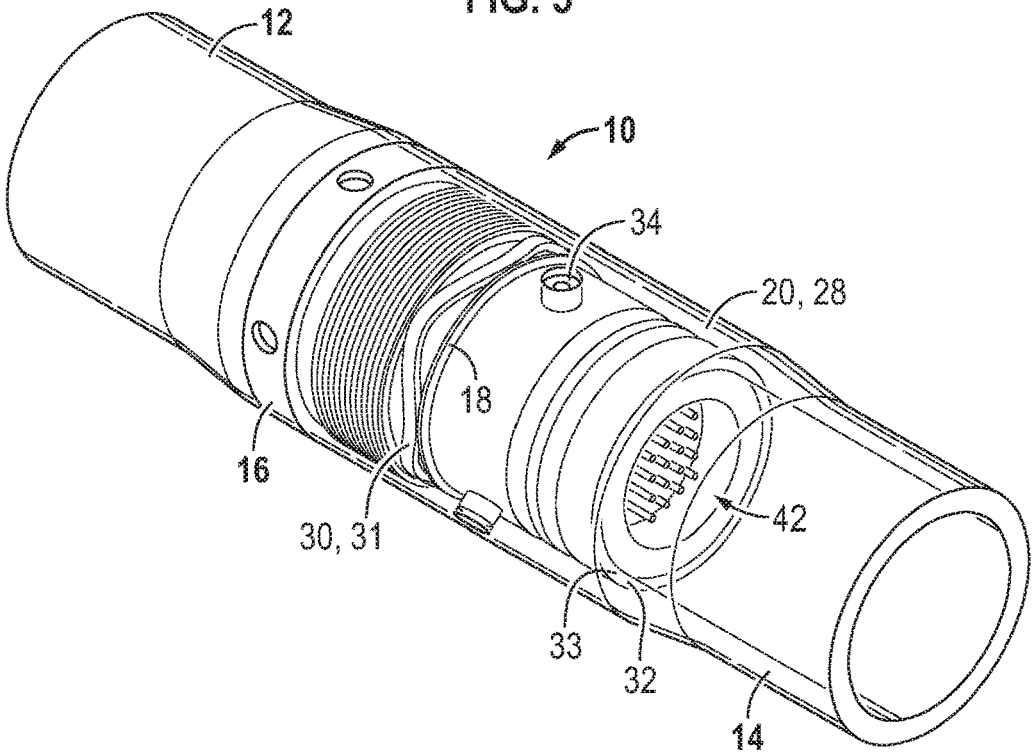
FIG. 5 is a perspective view of a downhole tool connection according to one or more aspects of the disclosure.

The elastic deformable member 20 and the threaded member 16 are engaged and torqued together. Torque is applied for example until the elastic deformable member 20, for example an internal lip 36, is contacting the shoulder 18 that is disposed with the second tool section 14. Internal lip 36 may be formed by a slip ring 22. At that point the defined tension load 38 is applied between the two sections 12 and 14 when the elastic deformable sleeve 20, 27 is made-up with the externally threaded member 16. A compressive force 40 is applied across the interface of a terminal hard shoulder or face 32 of the first tool 12 and a terminal hard shoulder or face 33 of the second tool 14. The desired tension force 38 in the joint is generated by a tensioning element 30 while the compressive load is applied to the hard shoulders. In FIGS. 1 and 2, the tensioning element 30 is provided in the form of weakness lines, specifically identified with reference number 29, which may be machined into the elastic deformable member 20. The number, shape, depth, and dimensions of the weakness lines 30, 29 may be configured to generate the desired tension 38. It will be recognized by those skilled in the art with reference to this disclosure that a tensioning member, such as a biasing member, could be operationally disposed with the elastic deformable member 20 to achieve the defined tensile force. For example, with reference to FIGS. 3-5, a tensioning member 30, 29 could be located between the shoulder 18 and the internal lip 36 such that full make-up of elastic deformable member 20, 27 with externally threaded member 16 will entail compression of tensioning member 30, 31 to achieve the defined tensile force (e.g., a nominal tensile force). In another example, a tensioning member may be located axially between the member 16 and the terminal hard shoulder or face 32 such that tensioning member acts against the axial movement of the member 16 when being made up with the member 20. It may be said that the operational engagement of the shoulder with one of the member 16 (e.g., free nut) and the elastic deformable member 20, 27 when the member 20, 27 is made up with the externally threaded member 16 applies the defined tensile force 38. In other words, the positioning of the stop engagement with the member 20 or member 16 relative to a make-up position of the threaded connection of the member 20 and the member 16 determines the tensile force achieved for example by deformation of the member 20 or compression of a tensioning member such as illustrated in FIGS. 3-5. In an example, a tensioning member may be located for example between the stop 18 and the sleeve 27 or between an end of the externally threaded member 16 and a shoulder or stop, for example the wall of the groove 15 in FIG. 1. It is noted that a tool connection assembly 10 may interconnect member 12 and 14 at various defined tensile forces for example by timing the extent of make-up of the threaded connection of members 16 and 20. For example, fully making-up the threaded connection between members 16, 20 may achieve a tensile force 38 different from making-up the threaded connection to a different extent. Accordingly, indicators may be provided to time the extent of making-up the threaded connection to achieve a desired tensile force or at least a minimum tensile force.

The connection assembly 10 can be geometrically locked for example by catching the elastic deformable member 20, 27 with a retaining ring 22. The tool sections 12, 14 cannot move along their main axis as they are under the load of a spring pack or a jam nut (e.g., shoulder 18), thus the threaded member 16 and the elastic deformable member 20 cannot untighten. When not in use for a drilling and measurement conditions, the connection assembly 10 can be secured for example by use of a self-lock main thread for example on the elastic deformable member, for example a shaped thread, serrated shape on the sleeve and/or threaded member, serrated washers in between the torqued elements, pressure locked, or by other locking manners. The high tension and friction in the elastic deformable member 20 provides locking that can withstand high shock and vibration.

The parts are not highly stressed at full torque, the split shoulder 18 and split nut 16 (FIGS. 1 and 2) are only in compressive or tensile force that are only a fraction the yield strength required in a bolted connection. The tensioning element 30 (e.g., weakness lines or spring) is under higher strength, depending on the design, however this is again still far lower than what a bolted connection should accept to produce the same tensile force. Thus the alloy used for the elastic deformable member 20 and the other parts can be a more standard one, for example aluminium bronze, copper nickel alloy or nitrogen alloyed stainless steel.

On small diameter tools where weakness lines 29 are difficult to machine reliably without reducing the reliability of the system itself, for example around one or two inch diameter. The weakness lines 29 can be replaced by a stiff bellow or spring, see e.g. FIGS. 3-5, to act the same way by allowing high deformation while maintaining high tensile force (relatively for the sub-assembly size) between the two parts.

Refer now to FIGS. 3, 4, and 5 illustrating a connection assembly 10 incorporating a tensioning element generally denoted by the numeral 30 in accordance to one or more aspects of the disclosure. In this embodiment, the tensioning element 30 is in the form of a bellow or spring identified specifically with the reference number 31. First tool section 12, male or pin end is illustrated mating with second tool section 14, female or box end, at contacting radial mating surfaces 24, 26 which may provide a hydraulic seal. In this embodiment the pin end is not threaded for mating connecting with the box end as in a traditional pin and box tubular connection. In accordance with embodiments, the pin end stabs into the box end for example to make electrical and/or hydraulic line connections internal to the first and second tool members 12, 14. A connector 42 is illustrated in FIG. 5 of an electrical and/or hydraulic line. In the illustrated example, the elastic deformable member 20 is in the form of a box end identified specifically with the reference number 28 of the second tool section 14. Box end 28 has threads 21 to engage with external threaded member 16 which is disposed about tool section 12. External threaded member 16, e.g., free nut, is disposed about tool section 12 for example in a groove or trap 15 to allow threaded member 16 to rotate about the tubular tool section 12 and prevent axial movement of threaded member 16. The front of the trap 15 between the externally threaded member 16 and the terminal face 32 may be formed by the first member 12 or by another stop, for example shoulder 18. Utilizing the rotatable external threaded member 16 (free nut) permits interconnecting the first and second downhole tool members 12, 14 without rotating the tool members and thereby facilitating making electrical and hydraulic line connections between the tool members.

A removable shoulder 18 may be provided between the externally threaded member 16 and terminal hard shoulder 32 of the first tool 12. In the illustrated connection, the removable shoulder 18 is provided for example by a circular clip. In FIGS. 3-5 the tensioning device or element 30 is illustrated as a compression spring 31 (e.g., wave spring) that is disposed between the shoulder 18 (i.e., stop) and the threaded member 16. In operation the threaded member 16 is engaged with the threads of box end 28. Externally threaded member 16 is rotated and torqued and thereby draws the second tool section 14 into contact with shoulder 18 compressing the spring tensioning element 30, 31. Locking members 34 can be engaged to axially lock the tool sections 12, 14 relative to one another. As illustrated in FIG. 4, this ensures the tensioning function and generates the required tensile force 38 across the connection joint and a minimum compressive force 40 between the terminal hard shoulder 32 of first tool section 12 and a hard shoulder 33 of second tool section 14 for example internal to box end 28.

In accordance to embodiment the connection assembly 10 is not highly stressed a full torque. The removable shoulder 18 and the threaded member 16 are only in compressive or tensile force that is only a fraction of the yield strength required in a bolted connection. The tensioning device or element 30 is under higher force, however, the yield strength of the tensioning device or element 30 is again lower that what a bolted connection should accept to produce the same tensile force, see e.g., FIG. 4. Due to the reduced yield strength needed the connection assembly can be constructed of more standard materials such as aluminium bronze, copper nickel alloy or nitrogen alloyed stainless steel. These materials have a high corrosion resistance and high galling pressure relative to some higher strength materials.

Figure 6:
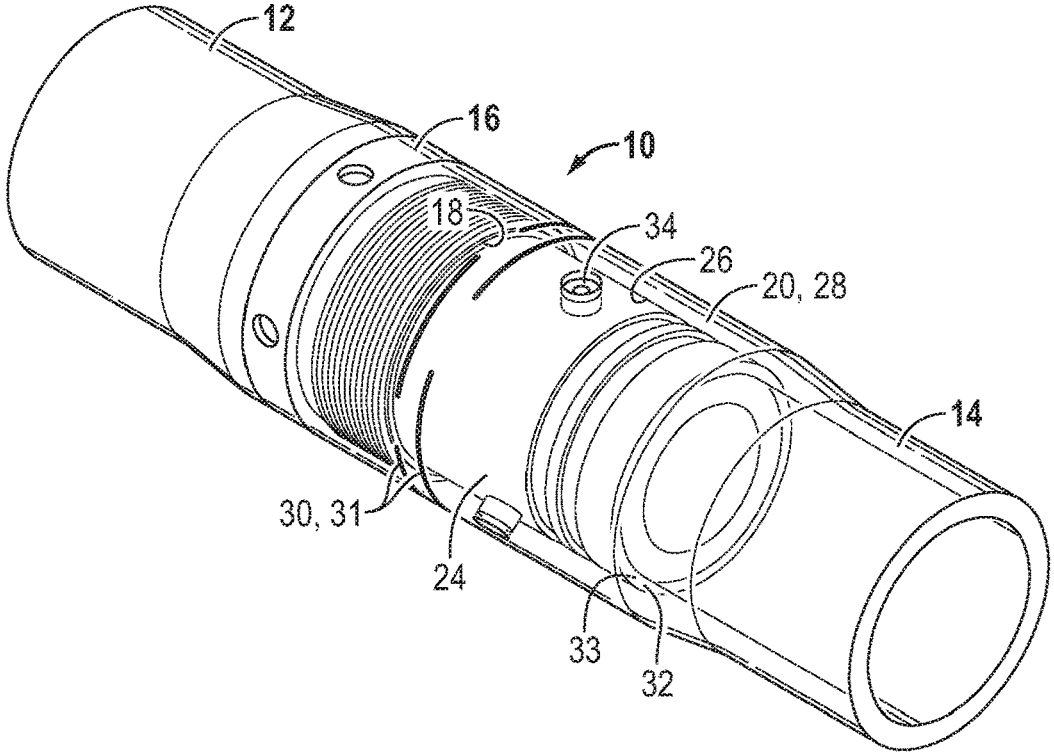
FIG. 6 is a perspective view of a downhole tool connection apparatus according to one or more aspects of the disclosure.

FIG. 6 illustrates a connection assembly 10 utilizing a tensioning element 30 in the form of weakness lines 29 formed, for example machined, in the elastic deformable box end 20, 28 of the second tool section 14. As in FIGS. 3-5, the box end 20, 28 in this embodiment may be an integral section of second member 14. In the illustrated connection assembly 10 of FIG. 6 the stop or shoulder 18 may be a removable member, e.g., a circle clip. In operation, threaded member 16 is mated with box end 20, 28 and torqued for example until fully threaded which deforms box end 28 via tensioning member 30, e.g. weakness line(s) 29. In this example the stop 18 may maintain externally threaded member 16 an axial location relative to box end. As discussed with regard to FIG. 4, this ensures the tensioning function and generates the required tensile force 38 and a minimum compressive force 40.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A downhole tool connection assembly for a bottom hole assembly disposed between a drill string and a drill bit, the connection assembly comprising:

an externally threaded member rotatably positioned about a first downhole tool;

an internally threaded member disposed with a second downhole tool to threadedly mate with the externally threaded member;

a stop located on one of the first downhole tool and the second downhole tool to act on one of the internally threaded member and the externally threaded member when threadedly connected, whereby the internally threaded member interconnects the first downhole tool and the second downhole tool with a defined tensile force and a compressive force at an abutting interface of a first hard shoulder of the first downhole tool against a second hard shoulder of the second downhole tool; and wherein the first downhole tool and the second downhole tool are sections or subsections of drilling and measurement tools, and the first hard shoulder and the second hard shoulder are planar surfaces extending perpendicular to a main axis of the interconnected first and second downhole tools.

2. The connection assembly of claim 1, wherein the stop is removably disposed about one of the first downhole tool and the second downhole tool.

3. The connection assembly of claim 1, wherein the defined tensile force is determined by a weakness line formed in the internally threaded member.

4. The connection assembly of claim 1, wherein the defined tensile force is determined by elastic axial deformation of the internally threaded member.

5. The connection assembly of claim 1, wherein the defined tensile force is determined by a tension member disposed between the stop and one of the internally threaded member and the externally threaded member.

6. The connection assembly of claim 1, wherein the internally threaded member is a sleeve rotatably disposed about the second downhole tool.

7. The connection assembly of claim 1, wherein the internally threaded member is a sleeve rotatably disposed about the second downhole tool and the defined tensile force is determined by a weakness line formed in the internally threaded member.

8. The connection assembly of claim 7, wherein the stop is located on the second downhole tool between an internal lip of the internally threaded member and the second hard shoulder.

9. The connection assembly of claim 1, wherein the internally threaded member is a box end of the second downhole tool.

10. The connection assembly of claim 1, wherein the internally threaded member is a box end of the second downhole tool and the defined tensile force is determined by a weakness line formed in the internally threaded member.

11. The connection assembly of claim 1, wherein the internally threaded member is a box end of the second downhole tool;

the defined tensile force is determined by a weakness line formed in the internally threaded member; and the stop is located on the first downhole tool between the externally threaded member and the first hard shoulder.

12. The connection assembly of claim 11, wherein the stop is removably connected to the first downhole tool.

13. The connection assembly of claim 1, comprising a tension member located between the stop and one of the internally threaded member and the externally threaded member; and wherein the internally threaded member is a box end of the second downhole tool.

14. The connection assembly of claim 13, wherein the stop is removably located on the first downhole tool.

15. A drilling system, comprising:

a bottom hole assembly deployed in a wellbore on a drill string, the bottom hole assembly having a first downhole tool connected to a second downhole tool by a connection assembly with a defined tensile force and a compressive force at an abutting interface of a first hard shoulder of the first downhole tool against a second hard shoulder of the second downhole tool, wherein the first downhole tool and the second downhole tool are sections or subsections of drilling and measurement tools, and the first hard shoulder and the second hard shoulder are planar surfaces extending perpendicular to a main axis of the interconnected first and second downhole tools;

the connection assembly comprising:

an externally threaded member rotatably positioned about the first downhole tool;

an internally threaded member disposed with the second downhole tool and threadedly mated with the externally threaded member; and a stop located on one of the first downhole tool and the second downhole tool to act on one of the internally threaded member and the externally threaded member when threadedly connected.

16. The drilling system of claim 15, wherein the internally threaded member is a sleeve rotatably disposed about the second downhole tool and the defined tensile force is determined by a weakness line formed in the internally threaded member.

17. The drilling system of claim 15, wherein the internally threaded member is a box end of the second downhole tool; and the defined tensile force is determined by one of a weakness line formed in the internally threaded member or a tension member located between the internally threaded member and the externally threaded member.

18. A method, comprising:

interconnecting, in a bottom hole assembly to be deployed in a wellbore on a drill string, a first downhole tool and a second downhole tool with a defined tensile force and a compressive force at an abutting interface of a first hard shoulder of the first downhole tool against a second hard shoulder of the second downhole tool, wherein the first downhole tool and the second downhole tool are sections or subsections of drilling and measurement tools, and the first hard shoulder and the second hard shoulder are planar surfaces extending perpendicular to a main axis of the interconnected first and second downhole tools;

the interconnecting comprising:

threading an externally threaded member rotatably positioned about the first downhole tool with an internally threaded member disposed with the second downhole tool, wherein a stop located on one of the first downhole tool and the second downhole tool to act on one of the internally threaded member and the externally threaded member when threadedly connected; and bringing, in response to the threading, the first hard shoulder and the second hard shoulder into contact at the abutting interface.

19. The method of claim 18, wherein the internally threaded member is a sleeve rotatably disposed about the second downhole tool and the defined tensile force is determined by a weakness line formed in the internally threaded member.

20. The method of claim 18, wherein the internally threaded member is a box end of the second downhole tool; and the defined tensile force is determined by one of a weakness line formed in the internally threaded member or a tension member located between the stop and the externally threaded member.

* * * * *